70-82 SF
10/15/85 OR 4,546,628

United States Patent [19]

Takasaki

[11] Patent Number: 4,546,628

[45] Date of Patent: Oct. 15, 1985

[54] HANDLE DEVICE FOR DOORS

[75] Inventor: Kunihiko Takasaki, Chiba, Japan

[73] Assignee: Takigen Seizou Co., Ltd., Tokyo, Japan

[21] Appl. No.: 615,949

[22] Filed: May 31, 1984

[30] Foreign Application Priority Data

Oct. 19, 1983 [JP] Japan ..... 58-161781

[51] Int. Cl.[4] ..... E05B 65/10

[52] U.S. Cl. ..... 70/92; 70/210; 292/92

[58] Field of Search ..... 70/92, 202, 208, 210, 70/81; 292/92, 139, 140, 143, 165, 166, 167, 168, 173, 174

[56] References Cited

U.S. PATENT DOCUMENTS 2,893,772 7/1959 Edwards ..... 292/92
3,494,650 2/1970 Slope ..... 292/92

FOREIGN PATENT DOCUMENTS 2747991 1/1979 Fed. Rep. of Germany ..... 70/92

*Primary Examiner*—Robert L. Wolfe
*Attorney, Agent, or Firm*—Martin Smolowitz

[57] ABSTRACT

A handle device for a door which is formed of an assembly installed in a door panel and has a handle grip connected thereto by a pivot pin. A latch is retractably mounted to the assembly and is interlocked with the handle grip. An actuating lever is pushed by the handle grip to move the latch. A reset lever drives the actuating lever when pushed by a push rod extending inside the door. A lock mounted on the assembly has a cam secured to a rotor, serves to release the engagement between a lock plate which is secured to the assembly and adapted to check the slide of the latch, and the latch. When the push rod turns the reset lever, engagement between the lock plate and the latch is released and the latch slides and is retracted by turning the actuating lever.

5 Claims, 4 Drawing Figures

HANDLE DEVICE FOR DOORS

BACKGROUND OF THE INVENTION

The present invention relates to a handle device for doors, and more particularly to a handle device in a large-sized refrigerator or the like with which a door can be opened by unlocking the door from inside it.

With a prior-art handle device for a door which permits the door to be opened from inside it, a handle grip is directly pushed by a push rod located inside the door, so as to slide and retract a latch.

Therefore, the unlocking operation is cumbersome. Moreover, when the movement of the handle grip is limited by an obstacle such as baggage put in front of the door or when the handle grip is locked with a padlock or the like, it is impossible to unlock the door from inside the same.

SUMMARY OF THE INVENTION

It is accordingly an object of the present invention to provide a handle device for a door with which the operation of unlocking the door is easily performed and with which the door can be readily unlocked from inside it even when the motion of a handle grip is limited by an obstacle lying in front of the door or when the handle grip itself is locked.

In one aspect of performance of the present invention, a handle device for a door comprises a device proper which is installed on a door panel, a handle grip which is connected to said device proper by a pivot pin, a latch which is retractably mounted on said device proper, an actuating lever which is connected in said device proper by said pivot pin and which is pushed by said handle grip to slide and retract said latch, a reset lever which is connected in said device proper by said pivot pin and which drives said actuating lever when pushed by a push rod extending inside the door, a lock plate which is secured to said device proper and which checks the retractive slide of said latch in engagement therewith, and a lock which is mounted on said device proper and which has a lock cam secured to a rotor, said lock cam releasing the engagement between said lock plate and said latch, so that when the inside push rod is pushed to turn said reset lever, the engagement between said lock plate and said latch is released, and said latch is slid and retracted by the turning of said actuating lever interlocked with said reset lever.

PREFERRED EMBODIMENT OF THE INVENTION

Figure 1:
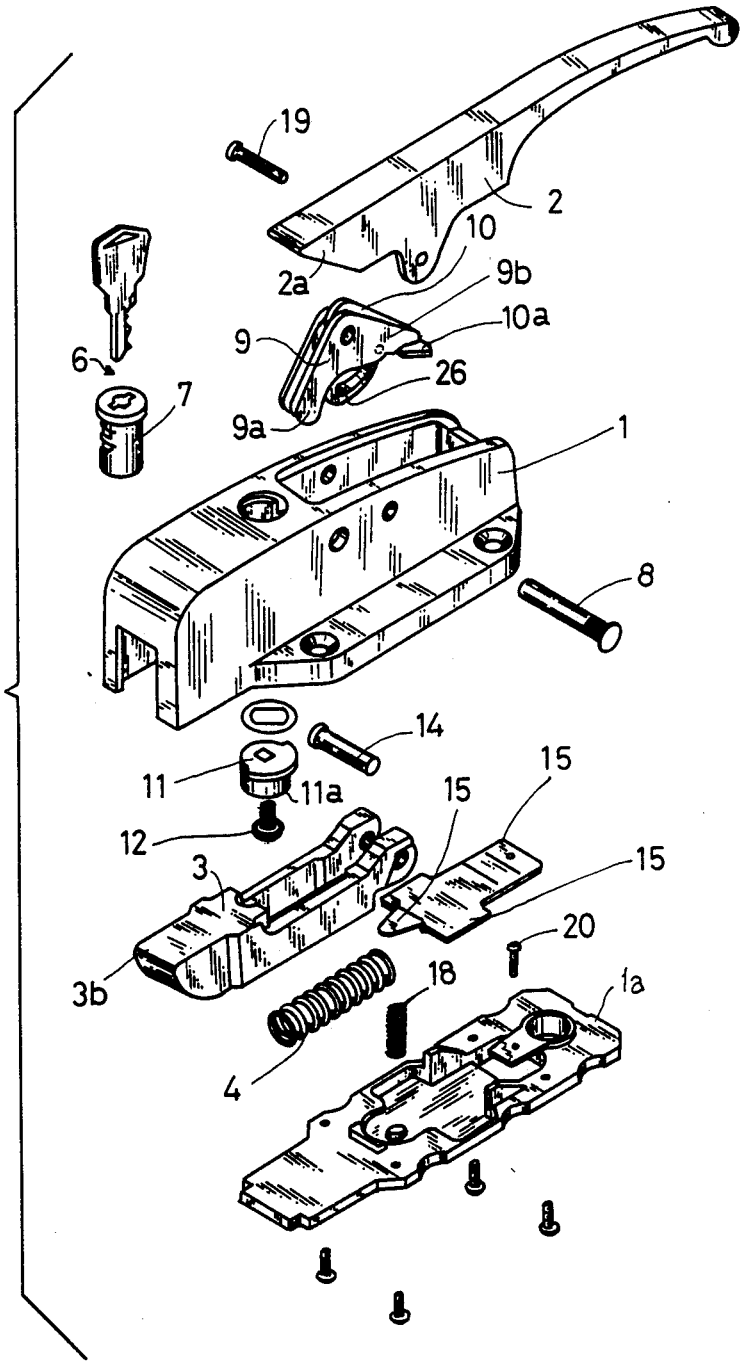
FIG. 1 is an exploded perspective view of a handle device for doors illustrative of an embodiment of the present invention.
Figure 2:
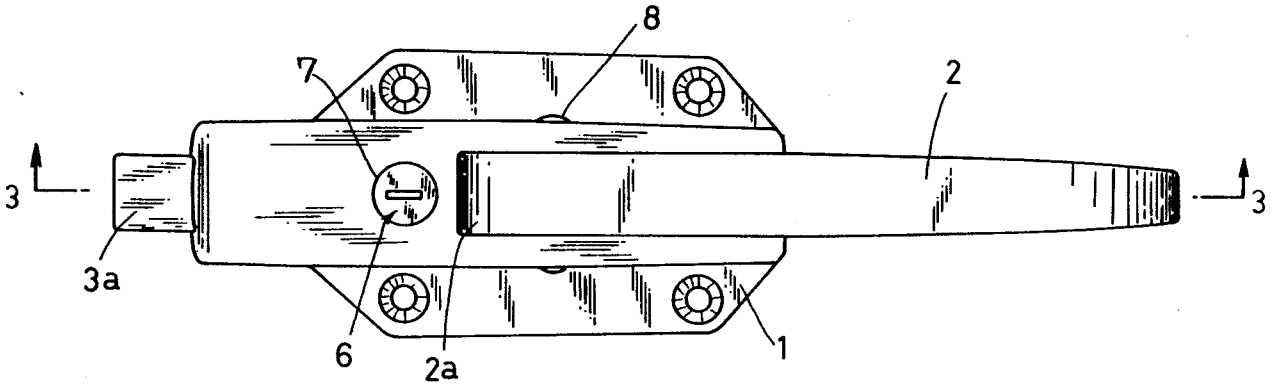
FIG. 2 is a front view of the handle device for doors.
Figure 3:
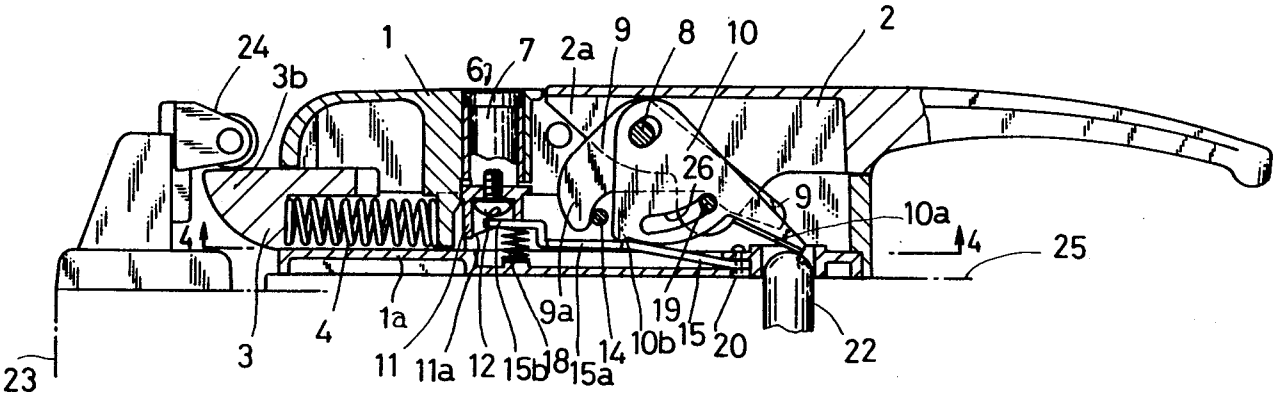
FIG. 3 is a sectional view taken along line A—A′ in FIG. 2.
Figure 4:
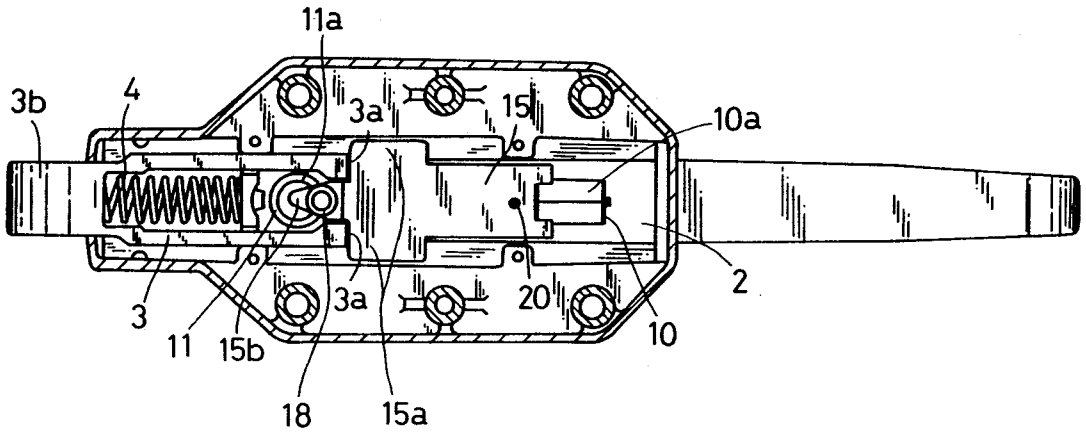
FIG. 4 is a sectional view taken along line B—B′ in FIG. 3.

The present invention will now be described with reference to the drawings illustrating an embodiment thereof. The handle device for doors according to the present invention has its device proper 1 installed on a door panel 25. A handle grip 2 is connected to the device proper 1 by a pivot pin 8. A latch 3 is retractably mounted on the device proper 1. An actuating lever 9 is connected in the device proper 1 by the pivot pin 8, and is pushed by the handle grip 2 to slide and retract the latch 3. A reset lever 10 is connected in the device proper 1 by the pivot pin 8, and drives the actuating lever 9 when pushed by a push rod 22 extending inside the door. A lock plate 15 is secured to the device proper 1, and checks the retractive slide of the latch 3 in engagement therewith. A lock 6 is mounted on the device proper 1, and has a lock cam 11 secured to a rotor 7, for releasing the engagement between the lock plate 15 and the latch 3.

In the illustrated embodiment, the lock plate 15 has its rear end part fixed to the device proper 1 by a screw 20, and it is pushed up by a coiled compression spring 18. The sideward lugs 15*a* of the lock plate 15 at the front end thereof, check the retractive slide of the latch 3 in engagement with the vertical walls 3*a* of the latch 3. The reset lever 10 has at its rear end part a driven piece 10*a* which is bent and formed at a right angle.

The lock cam 11 is secured to the rotor 7 by a screw 12. When the rotor 7 is rotated by 180 degrees by the use of a key inserted in the lock 6, the lock cam 11 releases the engagement between the sideward lugs 15*a* of the lock plate 15 and the vertical walls 3*a* of the latch 3 in such a manner that the slanted face 11*a* of the lock cam at the lower part thereof depresses the tongue 15*b* of the lock plate at the front end thereof.

When the handle grip 2 is drawn and rotated outside the door, e.g., outside a refrigerator, the actuating lever 9 is pushed by the driving portion 2*a* of the handle grip 2 at the front end thereof and is turned, and the front end part 9*a* of the actuating lever 9 drives a driven pin 14 at the rear end part of the latch 3 under traction. Owing to the tractive drive, the latch 3 is slid to recede against the urging of a spring 4.

During the rotation of the handle grip 2, the reset lever 10 rotates therewith under the traction of an interlocking pin 19 which is held in engagement with a circular slot 26 provided in this lever 10. Owing to the receding slide of the latch 3, the front end part 3*b* of the latch comes away from a seat 24 on the side of a refrigerator body 23, so that the door panel 25 is unlocked and becomes openable.

When the push rod 22 is pushed inside the door, namely, inside the refrigerator, its front end part pushes the back surface of the driven piece 10*a* of the reset lever 10 so s to turn this reset lever. At the initial stage of the turning, the lower part 10*b* of the reset lever 10 at the front end thereof, depresses the lock plate 15 so as to release the engagement between the lock plate 15 and the latch 3.

When the push rod 22 is further continued to be pushed in, the actuating lever 9 whose rear end part 9*b* abuts on the fore surface side of the driven piece 10*a* is driven to turn. The turning of the actuating lever 9 subjects the latch 3 to traction. Likewise to the foregoing, the door becomes openable owing to the receding slide of the latch 3.

With the device of the present invention constructed as thus far described, the handle grip 2 is not concerned at all by the operation of sliding and retracting the latch from inside the door. Therefore, even in such state in which the handle grip 2 is locked and fixed by passing the hook rod of a padlock through a keyhole or in which the handle grip 2 is immovable on account of an obstacle lying in front of the door, the latch 3 can be properly slid and retracted so as to open the door, and the danger of confining an operator within the refrigerator is eliminated. A further advantage is that, since the handle grip 2 need not be pushed and moved, the unlocking operation is easily performed.

I claim:

1. A handle device for a door comprising a device proper which is installed on a door panel, a handle grip which is connected to said device proper by a pivot pin, a latch which is retractably mounted on said device proper, an actuating lever which is connected in said device proper by said pivot pin and which is pushed by said handle grip to slide and retract said latch, a reset lever which is connected in said device proper by said pivot pin and which drives said actuating lever when pushed by a push rod extending inside the door, a lock plate which is secured to said device proper and which checks the retractive slide of said latch in engagement therewith, and a lock which is mounted on said device proper and which has a lock cam secured to a rotor, said lock cam releasing the engagement between said lock plate and said latch, so that when the inside push rod is pushed to turn said reset lever, the engagement between said lock plate and said latch is released, and said latch slides and is retracted by the turning of said actuating lever interlocked with said reset lever.

2. A handle device for a door according to claim 1, wherein said reset lever has a driven piece at its rear end and a lower protuberant portion at its front end, so that when said push rod is pushed against said driven piece from inside the door, said reset lever is turned, and said lower protuberant portion depresses said lock plate to disengage it from said latch.

3. A handle device for a door according to claim 2, wherein said latch has a driven pin at its rear end, and said actuating lever abuts on said driven piece at its rear end, so that when said push rod is further pushed, said actuating lever is turned to pull said driven pin and to slide and retract said latch.

4. A handle device for a door according to claim 2, wherein said reset lever rotates with said handle under traction of an interlocking pin held in engagement with a circular slot provided in said lever.

5. A handle device for a door according to claim 1, wherein said latch is urged against a stationary seat by a compression spring.

* * * * *